US010366666B2

(12) United States Patent
Jung et al.

(10) Patent No.: US 10,366,666 B2
(45) Date of Patent: Jul. 30, 2019

(54) DISPLAY APPARATUS AND METHOD FOR CONTROLLING THE SAME

(71) Applicant: SAMSUNG ELECTRONICS CO., LTD., Suwon-si (KR)

(72) Inventors: Jong-hoon Jung, Suwon-si (KR); Young-mok Park, Asan-si (KR); Dae-sik Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 345 days.

(21) Appl. No.: 15/171,025

(22) Filed: Jun. 2, 2016

(65) Prior Publication Data

US 2016/0365051 A1 Dec. 15, 2016

Related U.S. Application Data

(60) Provisional application No. 62/173,582, filed on Jun. 10, 2015.

(30) Foreign Application Priority Data

Dec. 7, 2015 (KR) ..... 10-2015-0173468

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3677* (2013.01);
(Continued)

(58) Field of Classification Search
CPC ..... G09G 3/3233; G09G 2300/0819; G09G 2300/0852; G09G 2300/0426;
(Continued)

(56) References Cited

U.S. PATENT DOCUMENTS 7,990,356 B2 8/2011 Chung et al.
2002/0047557 A1* 4/2002 Kim ..... G09G 3/20 315/169.3

(Continued)

FOREIGN PATENT DOCUMENTS

EP 2 096 621 A2 9/2009
JP 2001-255508 A 9/2001

(Continued)

OTHER PUBLICATIONS

International Search Report dated Sep. 13, 2016 issued by International Searching Authority in counterpart International Application No. PCT/KR2016/006152 (PCT/ISA/210).

(Continued)

*Primary Examiner* — Gerald Johnson
(74) *Attorney, Agent, or Firm* — Sughrue Mion, PLLC

(57) ABSTRACT

A display apparatus includes a display panel including pixels arranged at an intersection of data lines and gate lines, a source driver IC configured to be disposed on one side surface of the display panel to apply a data voltage to the data lines, a gate driver IC configured to be disposed on any one of two side surfaces which are adjacent to the one side surface of the display panel to apply a gate driving voltage to the gate lines, and a controller configured to receive feedback on a gate driving voltage applied to at least one pixel, detect a distortion of the gate driving voltage applied to the pixel based on the feedback, adjust a level of the gate driving voltage applied to the gate lines to compensate for the distortion of the gate driving voltage, and apply the adjusted gate driving voltage to the gate lines.

19 Claims, 11 Drawing Sheets

(52) U.S. Cl.
CPC . *G09G 2310/08* (2013.01); *G09G 2320/0223* (2013.01); *G09G 2320/0233* (2013.01)

(58) Field of Classification Search
CPC ..... G09G 3/3225; G09G 2320/0223; G09G 3/3648; G09G 3/3677
See application file for complete search history.

(56) References Cited

U.S. PATENT DOCUMENTS

| | | | | |
|---|---|---|---|---|
| 2002/0063703 | A1 | 5/2002 | Furuhashi et al. | |
| 2007/0120780 | A1 | 5/2007 | Park et al. | |
| 2010/0245317 | A1 | 9/2010 | Lin et al. | |
| 2011/0012521 | A1* | 1/2011 | Byun ..... | G09G 3/3406 315/186 |
| 2011/0080387 | A1 | 4/2011 | Park | |
| 2013/0147856 | A1 | 6/2013 | Chou et al. | |
| 2013/0235011 | A1 | 9/2013 | Lin et al. | |
| 2014/0327708 | A1 | 11/2014 | Yamakawa | |
| 2014/0340381 | A1* | 11/2014 | Kim ..... | G09G 3/3655 345/212 |

FOREIGN PATENT DOCUMENTS

| | | | |
|---|---|---|---|
| KR | 10-2008-0043009 | A | 5/2008 |
| KR | 10-2010-0000642 | A | 1/2010 |
| KR | 10-0994479 | B1 | 11/2010 |
| KR | 10-1186049 | B1 | 9/2012 |
| KR | 10-2013-0045749 | A | 5/2013 |
| KR | 10-2014-0005453 | A | 1/2014 |

OTHER PUBLICATIONS

Written Opinion dated Sep. 13, 2016 issued by International Searching Authority in counterpart International Application No. PCT/KR2016/006152 (PCT/ISA/237).

Communication issued by the European Patent Office dated Nov. 10, 2017 in counterpart European Patent Application No. 16807831.9.

Communication issued by the European Patent Office dated Feb. 2, 2018 in counterpart European Patent Application No. 16807831.9.

Communication dated May 31, 2019, issued by the European Patent Office in counterpart European Application No. 16 807 831.9.

* cited by examiner

FIG. 6

98 60

| RC DELAY VALUE | BRIGHTNESS OF BACKLIGHT |
|---|---|
| 10 | 60 |
| 20 | 70 |
| 30 | 80 |
| 40 | 90 |

DISPLAY APPARATUS AND METHOD FOR CONTROLLING THE SAME

CROSS-REFERENCE TO RELATED APPLICATIONS

This application claims the benefit of the filing date of U.S. Provisional Application No. 62/173,582, filed on Jun. 10, 2015, and claims priority from Korean Patent Application No. 10-2015-0173468, filed on Dec. 7, 2015, in the Korean Intellectual Property Office. The disclosures of these applications are incorporated herein by reference in their entireties.

BACKGROUND

1. Field

Exemplary embodiments relate to a display apparatus and a method for controlling the same, and more particularly, to a display apparatus which compensates for brightness non-uniformity of a display panel and a method for controlling the same.

2. Description of the Related Art

Recently, a liquid crystal display (LCD) has become widely popular because of its appealing characteristics, such as, light weight, flat-panel, low-power operation, and so on. Accordingly, the LCD is being used in office automation (OA) equipment, audio/video devices, and diverse user terminal apparatuses. The LCD displays an image by controlling an amount of a light beam transmitted according to an image signal applied to a plurality of control switches arranged in a matrix form.

The LCD is a light receiving element which cannot emit light. Accordingly, the LCD includes a backlight having a high transmittance on a rear surface of a liquid crystal panel such that a user is able to view an image displayed on the LCD.

However, for example, because of an increased size of the panel of a large LCD, a resistance-capacitance (RC) delay of each gate line (an electrical RC delay time taken to turn on the last end pixel of the gate line) increases accordingly. When the RC delay increases, non-uniformity of screen brightness increases. In order to resolve this problem, the related art has used a method of connecting a gate driver integrated circuit (IC) to one side surface of a display panel, connecting another gate driver IC for compensating for an RC delay to the other side surface of the display panel, and applying gate power to each line of the display panel through the gate driver ICs on both side surfaces.

However, the above-described method requires that a bezel for the gate driver IC is present on each of the side surfaces of the display panel. In the case of a multi-display system where a plurality of display apparatuses are connected, as for example, in a multi-vision apparatus, a bezel mounted on a connection end of each display apparatus interrupts presentation of a view. In addition, the number of driver ICs is increased by two, and, thus, this negatively affects price competitiveness of a product.

Thus, there is a need for methods and apparatuses for compensating for brightness non-uniformity due to an RC delay even though a gate driver IC is mounted on only one side surface of a display panel.

SUMMARY

Exemplary embodiments may address at least the above problems and/or disadvantages and other disadvantages not described above. Also, exemplary embodiments are not required to overcome the disadvantages described above, and may not overcome any of the problems described above.

One or more exemplary embodiments provide a display apparatus which compensates for bright non-uniformity without an RC delay even though a gate driver IC is mounted on only one side surface of a display panel and a method for controlling the same.

According to an aspect of an exemplary embodiment, there is provided a display apparatus. The apparatus includes a display panel configured to include a plurality of pixels arranged at an intersection of data lines and gate lines, a source driver IC configured to be disposed on one side surface of the display panel to apply a data voltage to the data lines, a gate driver IC configured to be disposed on any one of two side surfaces which are adjacent to the one side surface of the display panel to apply a gate driving voltage to the gate lines, and a controller configured to receive feedback on a gate driving voltage applied to at least one pixel among the plurality of pixels, detect distortion of the gate driving voltage applied to the at least one pixel based on the feedback, adjust a level of the gate driving voltage applied to the gate lines to compensate for the distortion of the gate driving voltage, and apply the adjusted gate driving voltage to the gate lines.

The apparatus may further include a timing controller configured to control a timing at which the data voltage and the gate driving voltage are applied. In addition, the controller may be disposed between the timing controller and the gate driver IC to apply the adjusted gate driving voltage according to a timing signal applied from the timing controller.

The gate driving voltage may be applied to the gate lines as a square wave. In response to an insufficient charging time occurring in the at least one pixel due to the distortion of the gate driving voltage, the controller may raise a level of a voltage of a section in which the insufficient charging time occurred in the square wave in order to compensate for the insufficient charging time.

The controller may receive feedback on a gate driving voltage applied to at least one pixel located at a position farthest from the gate driver IC among the plurality of pixels.

The apparatus may further include a backlight unit configured to supply a backlight to the display panel and a backlight driver configured to drive the backlight unit. The backlight driver may drive the backlight unit such that brightness of the backlight supplied to the backlight unit increases in a direction away from the gate driver IC.

The controller may generate a synchronization signal every time the gate driving voltage is applied to the gate lines and transmit the generated synchronization signal to the backlight driver. The backlight driver may drive the backlight unit to supply the backlight upon the gate driving voltage being applied based on the received synchronization signal.

The apparatus may further include a storage configured to include a lookup table where each of the plurality of pixels of the display panel is matched with a brightness value of a light source to be irradiated to each of the pixels in order to maintain brightness of the display panel consistently according to a position of each of the pixels of the display panel. The backlight driver may drive the backlight unit by using the pre-stored Lookup Table.

The backlight driver may increase the brightness of the backlight linearly.

The apparatus may further include a backlight unit configured to supply a backlight to the display panel and a backlight driver configured to drive the backlight unit. A position of a light source of the backlight unit may be adjusted such that brightness of pixels of the gate lines is maintained consistently.

According to an aspect of an exemplary embodiment, there is provided a method for controlling a display apparatus. The method includes receiving feedback on a gate driving voltage applied to at least one pixel among a plurality of pixels arranged at an intersection of data lines to which a data voltage is applied by a source driver IC and gate lines to which a gate driving voltage is applied by a gate driver IC, on a display panel, detecting distortion of the gate driving voltage applied to the at least one pixel based on the feedback, adjusting a level of the gate driving voltage applied to the gate lines to compensate for the distortion of the gate driving voltage, and applying the adjusted gate driving voltage to the gate lines.

The applying may include applying the adjusted gate driving voltage according to a timing signal applied from a timing controller configured to control a timing at which the data voltage and the gate driving voltage are applied.

The gate driving voltage may be applied to the gate lines as a square wave. In response to an insufficient charging time occurring in the at least one pixel due to the distortion of the gate driving voltage, the adjusting may include raising a level of a voltage of a section in which the insufficient charging time occurred in the square wave in order to compensate for the insufficient charging time.

The receiving the feedback may include receiving feedback on a gate driving voltage applied to at least one pixel located at a position farthest from the gate driver IC among the plurality of pixels.

The method may further include increasing brightness of a backlight supplied to a backlight unit in a direction away from the gate driver IC.

The increasing the brightness of the backlight may include generating a synchronization signal every time the gate driving voltage is applied to the gate lines and supplying the backlight upon the gate driving voltage being applied based on the received synchronization signal.

The increasing the brightness of the backlight may include increasing the brightness of the backlight by using a lookup table where each of the plurality of pixels of the display panel is matched with a brightness value of a light source to be irradiated to each of the pixels in order to maintain brightness of the display panel consistently according to a position of each of the pixels of the display panel.

The increasing may include increasing the brightness of the backlight linearly.

According to the above-described various exemplary embodiments of the present disclosure, a difference in a display quality between a left-side pixel and a right-side pixel of a display panel due to a signal delay may be improved even though a gate driver IC is mounted on only one side surface of the display panel, and thus, a size of a bezel of the display panel may be reduced.

BRIEF DESCRIPTION OF THE DRAWINGS

The above and/or other aspects will become more apparent by describing certain exemplary embodiments with reference to the accompanying drawings, in which:

FIG. 6 is a view provided to describe a lookup table where backlight brightness values adjusted according to RC delay values are matched with the RC delay values according to an exemplary embodiment;

DETAILED DESCRIPTION

Figure 1A:
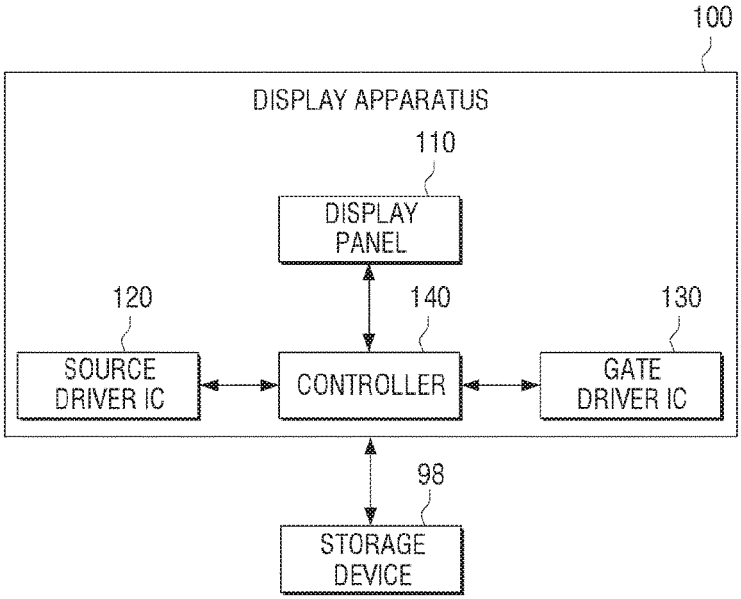
FIG. 1A is a block diagram illustrating a structure of a display apparatus according to an exemplary embodiment.

Certain exemplary embodiments are described in greater detail below with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, it is apparent that the exemplary embodiments can be practiced without those specifically defined matters. Also, well-known functions or constructions are not described in detail since they would obscure the description with unnecessary detail.

The terms used in the following description and claims are common expressions selected by considering functions in various exemplary embodiments. However, such terms may vary depending upon an intention of a person having ordinary skill in the art, legal/technical interpretation, or advent of new technology. In addition, some of the terms were selected arbitrarily by an applicant. The terms may be interpreted as defined herein. Unless otherwise defined, the terms may be interpreted based on overall descriptions of the present disclosure and common technical knowledge in the art.

In the following description and claims, a term including an ordinal, such as, 'first,' 'second,' etc., may be used to distinguish elements. The ordinal is used to distinguish the same or similar elements and does not limit the meaning of the term. For instance, ordinals do not affect an order of use or an order of arrangement of elements expressed with the ordinals. Respective ordinals may be replaced with each other, if necessary.

A term in a singular form includes a plural form unless it is intentionally written that way. In addition, in the following description, the term 'include' or 'have' refers to the disclosed feature, number, step, operation, element, part, or combination thereof and is not intended to exclude any possibilities of existence or addition of one or more other features, numbers, steps, operations, elements, parts or combination thereof.

In the following description, the term 'module,' 'unit,' or 'part' refers to an element which performs at least one function or operation. The 'module,' 'unit,' or 'part' may be realized as hardware, software, or combination thereof. In addition, a plurality of 'modules,' 'units,' and 'parts' may be integrated into at least one module or chip such that it may include at least one processor except for a case where respective 'modules,' 'units,' and 'parts' need to be realized as discrete specific hardware.

When it is described that one part is connected to another part, the connection includes a direct connection of the parts and an indirection connection through other medium. In addition, the description that a certain part includes an element signifies that the part may further include other elements rather than signifying that the part excludes other elements, unless otherwise described.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

Figure 1B:
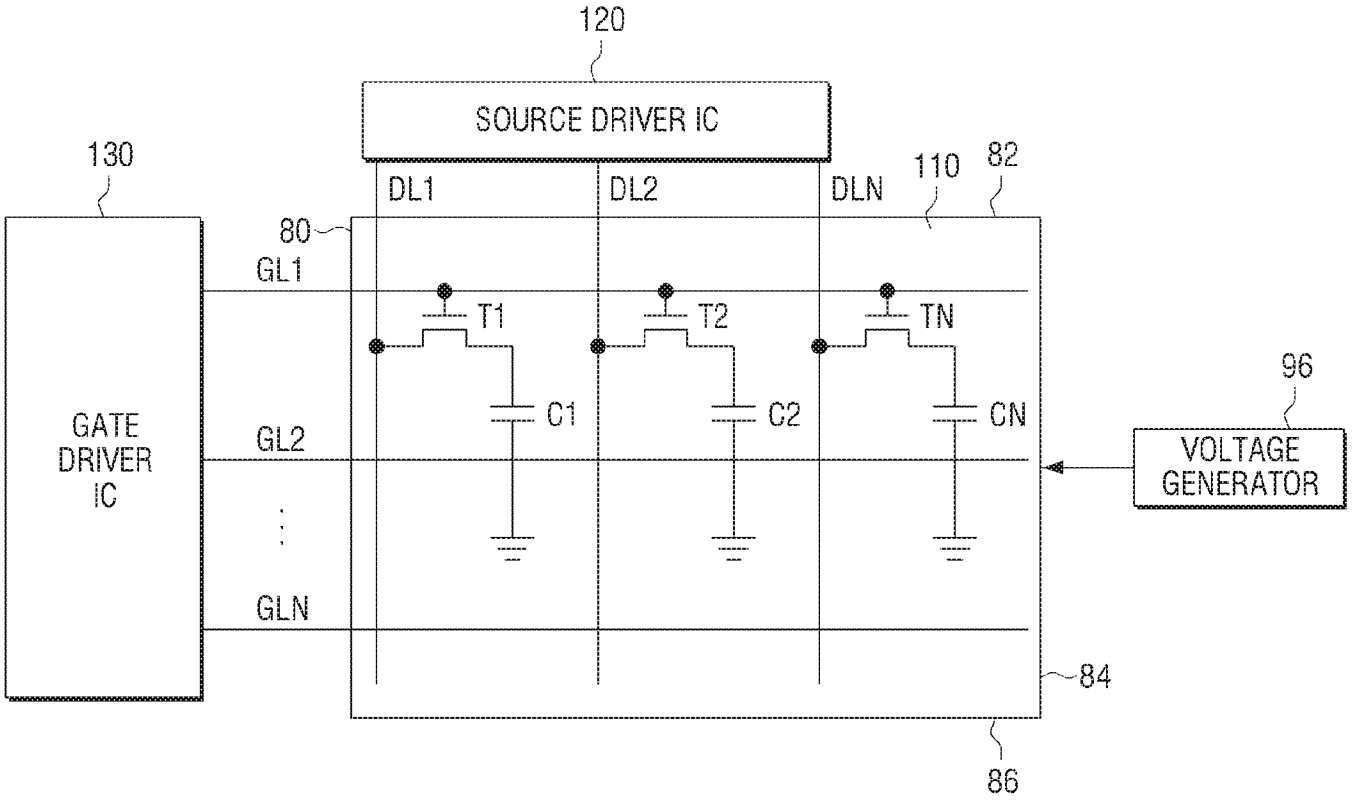
FIG. 1B is a block diagram illustrating a structure of a display panel according to an exemplary embodiment.

FIG. 1A is a block diagram illustrating a structure of a display apparatus according to an exemplary embodiment. FIG. 1B illustrates a display panel according to an exemplary embodiment.

According to an exemplary embodiment, a display apparatus 100 may include various types of image-processable monitors including a television (TV), a smart phone, a portable terminal, a mobile terminal, a personal digital assistant (PDA), a portable multimedia player (PMP), a computer, a laptop computer, a notepad, a wireless broadband Internet (WiBro) terminal, a tablet personal computer (PC), a smart TV, and the like.

Referring to FIG. 1A, the display apparatus 100 according to an exemplary embodiment includes a display panel 110, a source driver IC 120, a gate driver IC 130, and a controller 140.

The display panel 110 displays image data. For example, the display panel 110 may include a gate-in-panel (GIP) structure where a gate line is installed in a panel. For example, the display panel 110 may include a thin film transistor-LCD (TFT-LCD) panel, but this is not limiting. That is, a display panel of an exemplary embodiment may include any other appropriate display panel.

For example, a TFT-LCD has a matrix-type pixel structure. For example, in this structure, a plurality of gate lines intersect a plurality of data lines perpendicularly, and a pixel region is formed between each gate line and each data line. The pixel region includes a TFT and a liquid crystal to display a screen. A pixel includes an electrode layer including an upper electrode and a lower electrode. The upper electrode refers to a pixel electrode, and the lower electrode refers to a common electrode. An on/off state of the TFT is controlled depending upon a level of a gate voltage applied to the gate lines. In response to the TFT being turned on, a data voltage applied through the data lines is supplied to a pixel electrode of a corresponding pixel, and display of the pixel is performed according to a difference between the data voltage and a voltage applied to a common electrode.

The display panel 110 is connected with the source driver IC 120 and the gate driver IC 130. A gate driving voltage and a data voltage are supplied to the display panel 110 through the gate driver IC 130 and the source driver IC 120, respectively.

FIG. 1B illustrates a display panel 110 according to an exemplary embodiment.

The display panel 110 includes an LCD panel in which liquid crystal cells are arranged in a matrix form. The display panel 110 includes a plurality of gate lines GL1 and GL2 to GLN, a plurality of data lines DL1 and DL2 to DLN, a plurality of TFTs T1 and T2 to TN, and a plurality of capacitors C1 and C2 to CN. Although only one gate line is illustrated to have TFTs and capacitors, the remaining data lines GL2 to GLN have similar components.

The plurality of gate lines GL1 and GL2 to GLN receives a plurality of gate signals from a gate driver IC 130.

The plurality of data lines DL2, DL2, . . . and DLN crosses the plurality of gate lines and receives a data voltage from a source driver IC 120 corresponding to a data signal.

The plurality of TFTs T1, T2, . . . and TN is formed at an intersection of the gate lines GL1 and GL2 to GLN and the data lines DL1, DL2, . . . and DLN. Each of the capacitors C1, C2, . . . , CN, which are connected between the TFTs and a voltage generator 96 supplying a voltage, form a single pixel. A gate electrode of the each TFT is connected to the gate lines GL1 and GL2 to GLN, and a source electrode of the TFT is connected to the data lines DL1, DL2, . . . and DLN. Each pixel area (not shown) is formed at an intersection of the gate lines GL1 and GL2 to GLN and the data lines DL1, DL2, . . . and DLN, and a pixel electrode is formed in the pixel area.

The plurality of capacitors C1, C2, . . . , CN includes the pixel electrode, the common electrode which receives a common voltage from the voltage generator 96, and liquid crystal which is interposed between the pixel electrode and the common electrode.

If a predetermined signal is applied from the gate lines GL1 and GL2 to GLN and the data lines DL1, DL2, . . . and DLN to turn on the TFTs T1, T2, . . . and TN, a data voltage which is supplied to the data lines DL1, DL2, . . . and DLN is applied to a pixel electrode through the TFTs. An electric field which falls under a difference between a data voltage applied to the pixel electrode and a common voltage supplied by the voltage generator 96 is applied to the capacitors C1, C2, . . . , CN and light passes through at the transmissivity ratio corresponding to the strength of the electric field.

An array structure of a source driver IC and a gate driver IC in a display panel may be divided into a single bank structure where one source driver IC and one gate driver IC are arrayed on only a certain side of the display panel (see reference numerals 80, 82 in FIG. 1B) and a dual bank structure where two source driver ICs and two gate driver ICs are arrayed on both sides of the display panel. As shown in FIG. 1B, there is no source driver IC and no gate driver IC on sides 84, 86 of the display panel 110.

As a display panel is becoming larger and a multi-vision technology develops, a dimension occupied by the source driver IC and the gate driver IC needs to be reduced. The single bank structure is more desirable in this regard, but the single bank structure is not widely used due to a signal delay which occurs at a gate line in a display panel in the single bank structure.

For example, when the gate driver IC is disposed on a left side of the display panel and the gate driving voltage is applied to any arbitrary gate line, a gate driving voltage which is actually measured at the rightmost position of the gate line (a position of CN on one of the corresponding gate lines closest to a right side 84 in FIG. 1B) has a waveform which is delayed more than a gate voltage which is actually measured at the leftmost position of the gate line (a position of C1 on one of the corresponding gate lines closest to a left side 80 in FIG. 1B). Accordingly, a kickback voltage of a pixel region at each position varies depending upon the delay of the gate driving voltage since a charge is supplied through a TFT of a pixel at a corresponding position during a predetermined period of time of applying a delayed waveform of the gate driving voltage. For example, even though a data voltage in the same gradation is applied to a pixel of one line, a left-side pixel which is closest to the gate driver IC and a right-side pixel which is farthest from the gate driver IC are charged with different voltages. A difference in the charged voltages causes deterioration of a display quality due to a difference in brightness of a left-side pixel, e.g., corresponding to C1, and a right-side pixel, e.g., corresponding to CN, of the display panel, a direct current (DC) stress with respect to a liquid crystal material, and an afterimage problem, which degrades image quality. The controller 140 is a component for resolving the above-described problems. The controller 140 controls overall operations of the display apparatus 100.

For example, the controller 140 may receive a feedback signal Fb on a gate driving voltage applied to at least one pixel among a plurality of pixels and detect distortion of the gate driving voltage applied to the at least one pixel based on the feedback. In order to compensate for the distortion of the gate driving voltage, the controller 140 may adjust a level of a gate driving voltage applied to the gate lines and apply the adjusted gate driving voltage to the gate lines.

That is, at least one of the plurality of pixels included in the gate lines may be connected to the controller 140 and supply the applied gate driving voltage to the controller 140 as a feedback voltage. For example, the pixel which supplies the feedback voltage to the controller 140 is a pixel where the most intense distortion of the gate driving voltage occurs among the pixels included in the gate lines, that is, a pixel located at a position which is farthest from the gate driver IC 130.

Figure 2:
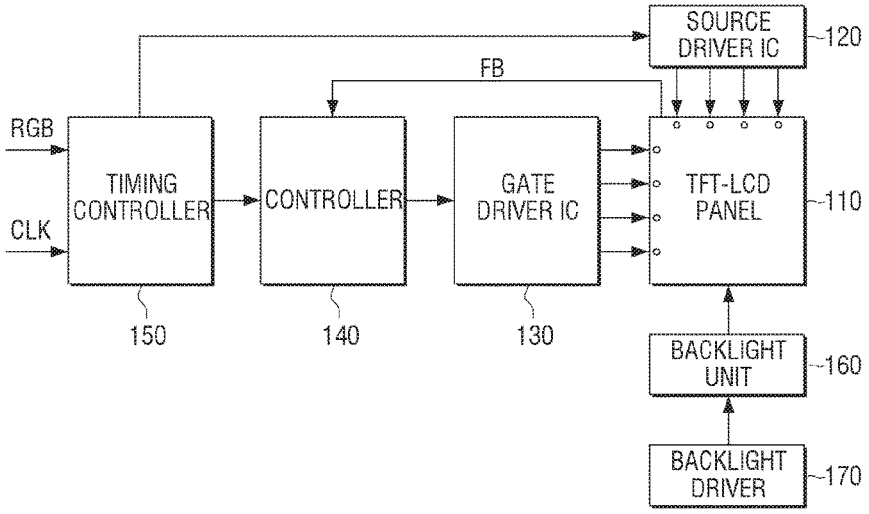
FIG. 2 is a block diagram illustrating a detailed structure of a display apparatus according to an exemplary embodiment.

FIG. 2 is a block diagram illustrating a detailed structure of a display apparatus according to an exemplary embodiment.

Referring to FIG. 2, a timing controller 150 controls a timing at which a data voltage and a gate driving voltage are applied. For example, the timing controller 150 receives RGB data, that is, a chrominance signal, a horizontal synchronization (H-SYNC) signal, a vertical synchronization (V-SYNC) signal, a clock signal (MCLK), and a data enable signal (DE). The timing controller 150 may receive voltages supplied from a voltage generator (not shown), adjust a timing of the signals, and generate signals for driving the display panel 110.

The timing controller 150 converts a format of the RGB data to correspond to a specification of an interface of the source driver IC 120 and outputs the converted RGB data through the source driver IC 120. In addition, the timing controller 150 outputs a data control signal (for example, an output start signal (TP), a horizontal start signal (STH), and a clock signal (HCLK)) through the source driver IC 120 and outputs a gate control signal (for example, a vertical start signal (STV), a gate clock signal (CPV), and an output enable signal (OE)) through the gate driver IC 130.

The source driver IC 120 may receive a gradation voltage generated in the voltage generator through the timing controller 150, select a proper gradation voltage according to the RGB data, convert the selected gradation voltage into a voltage which may be applied to the display panel 110, and apply the converted voltage to each data line of the display panel 110.

For example, the source driver IC 120 selects gradation voltages corresponding to the RGB data among the generated gradation voltages in response to the data control signal (TP, STH, and HCLK) transmitted from the timing controller 150 and apply the selected gradation voltages to each data line of the display panel 110.

The gate driver IC 130 may receive a gate voltage generated in the voltage generator through the timing controller 150, convert the received gate voltage into a voltage which may be applied to the display panel 110, and apply the converted voltage to each gate line of the display panel 110.

For example, the gate driver IC 130 receives a gate-on voltage (Von) and a gate-off voltage (Voff) and outputs a gate driving voltage having the gate-on voltage (Von) sequentially in response to the gate control signal (STV, CPV, and OE) transmitted from the timing controller 150. The gate driving voltage is applied to the gate lines of the display panel 110 sequentially and scans the gate lines sequentially. For example, the display apparatus 100 may further include a regulator configured to convert an input voltage into a gate-on voltage (Von) and a gate-off voltage (Voff) and output the converted voltages.

In response to the gate signals sequentially being applied to the gate lines, the data signals are applied to the data lines in synchronization with the gate signals. In response to the gate signal being applied to the selected gate line, a TFT connected to the selected gate line is turned on according to the gate signal. In response to the data signal being applied to the data line connected to the TFT which has been turned on, the applied data signal is charged into a liquid crystal capacitor and a storage capacitor by passing the turned-on TFT.

The liquid crystal capacitor controls light transmittance of a liquid crystal according to the charged voltage. The storage capacitor may maintain a charged state of the liquid crystal capacitor by accumulating the data signal in response to the TFT being turned on and applying the accumulated data signal to the liquid crystal capacitor in response to the TFT being turned off. The display panel 110 may display an image in this manner.

As illustrated in FIG. 2, the controller 140 may be disposed between the timing controller 150 and the gate driver IC 130. The controller 140 may receive a timing signal for controlling a timing at which the data voltage and the gate driving voltage are applied from the timing controller 150.

The controller 140 may apply the gate driving voltage of which level has been adjusted to the gate lines according to the timing signal applied from the timing controller 150. As the controller 140 applies the adjusted gate driving voltage to the gate lines, a charging time of each pixel may be compensated according to the original gate driving voltage even though the applied gate driving voltage is distorted. The controller 140 may be referred to as 'compensation circuit' in this regard.

For example, the gate driving voltage may be applied to the gate lines as a square wave. In order to compensate for an insufficient charging time which occurs in at least one pixel due to the distorted gate driving voltage, the controller 140 may raise a level of a voltage of a section in which the insufficient charging time occurred in the square wave. For example, the square wave may raise a level of a voltage of a section after a certain period of time from when a gate is changed from an OFF state to an ON state (OFF-ON section) and a section before a certain period of time from when the gate is changed from the ON state to the OFF state (ON-OFF section). The detailed description will be provided below with reference to FIG. 3.

The voltage generator may generate and supply a voltage for driving the display panel 110. That is, the voltage generator may generate a gate-on/off voltage, a gradation voltage, and/or a common electrode voltage and supply the generated voltage to the timing controller 150. The voltage generator may be the same as the voltage generator 96 of FIG. 1B or different.

The display panel 110 may receive a backlight from the backlight unit 160 and the backlight driver 170.

The backlight unit 160 may be disposed on a rear surface of the display panel 110. The backlight unit 160 may supply a light with desired brightness to the display panel 110 in response to a driving signal transmitted from the backlight driver 170. The backlight unit 160 may include a plurality of light sources. The plurality of light sources may include a plurality of light emitting diodes (LEDs) (refer to FIG. 8). The plurality of LEDs may be connected to each other in series on a printed circuit board (PCB) forming a plurality of blocks.

The backlight driver 170 may generate a clock signal and a brightness data signal which synchronizes with the clock signal in response to an enable signal. The brightness data signal includes brightness information for controlling brightness of the backlight unit 160.

Figure 3A:
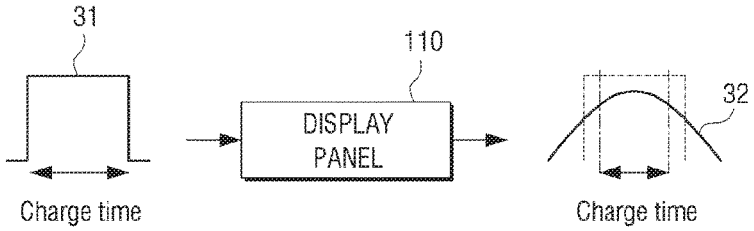
FIG. 3A (RELATED ART)
FIG. 3A is a view provided to describe a process where a gate driving voltage is distorted thereby causing an insufficient charging time.

FIG. 3A is a view provided to describe a process where a gate driving voltage is distorted thereby causing an insufficient charging time.

As illustrated in FIG. 3A, a gate driving voltage which is applied through the gate driver IC 130 during one horizontal scanning period (one frame) has a waveform 31, e.g., a square wave. A pulse of the gate driving voltage is formed with a width allowing a sufficient charging time for each pixel. An amplitude of the gate driving voltage is formed to be higher than a gate-on level of a field effect transistor (FET) element. Upon the gate driving voltage being applied to each gate line of the display panel 110, distortion according to an RC delay occurs. The distortion may weaken a charging characteristic of each pixel.

More particularly, a waveform of the gate driving voltage is changed to a waveform 32 where a high-level section becomes shorter according to the distortion, and, thus, a charging time of a pixel becomes insufficient, which becomes worse as a signal delay becomes greater. Specifically, the distortion appears more intense at a pixel located at a position which is farthest from the gate driver IC 130 among the plurality of pixels of the gate line. As a sufficient charging time of a pixel is not achieved, deterioration of a contrast ratio and bright non-uniformity may occur. Specifically, such problems occur intensely when a data voltage has a broad amplitude, for example, high voltage driving.

Figure 3B:
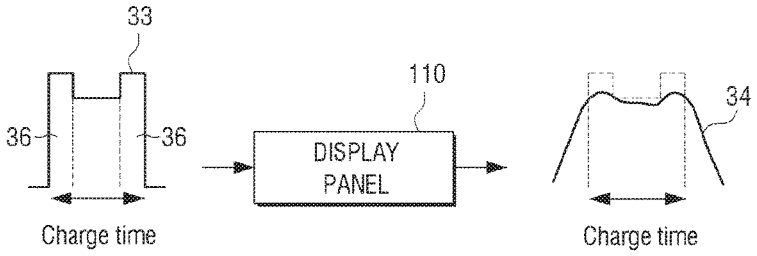
FIG. 3B is a view provided to describe a waveform of a gate driving voltage for compensating for an insufficient charging time according to an exemplary embodiment.

FIG. 3B is a view provided to describe a waveform of a gate driving voltage for compensating for an insufficient charging time, according to an exemplary embodiment.

Referring to FIG. 3B, in order to compensate for an insufficient charging time which occurs in at least one pixel due to the distorted gate driving voltage, the controller 140 may control to raise a level of a voltage of one or more sections 36 in which the insufficient charging time is predicted to occur in a current frame based on a received feedback signal providing information about the previous frame, and apply the higher voltage value in a section of the square wave. For example, an amplitude of a section in which an insufficient charging time in a waveform of the gate driving voltage, that is, a section in which a loss of charging time occurs due to the distortion, may be higher than the gate-on level voltage. For example, the amplitude of the section which the loss of charging time occurs may be formed to be high enough to secure a high-level section for allowing a sufficient charging time despite occurrence of the distortion.

As illustrated in FIG. 3B, the controller 140 may apply the gate driving voltage having a waveform 33 for compensating for the signal loss due to the distortion, to each gate line of the display panel 110. For example, the gate driving voltage may be changed to a gate driving voltage having a distorted waveform 34 while passing the pixels of the gate line.

The gate driving voltage having the distorted waveform 34 secures a charging time of the gate driving voltage before distortion even though it is distorted, by having an amplitude of sufficiently high value for a duration of a certain charging time, and thus, a difference in a charging voltage of the pixels due to the RC delay along the gate line may be substantially eliminated. In addition, it is possible to avoid unnecessary application of an excessive voltage to each of the pixels, by increasing an amplitude size only in one or more sections of the waveform where a certain distortion is expected, rather than increasing an amplitude size of an entire square wave. Accordingly, the charging time of each pixel may be secured even though the distortion might still occur due to the RC delay.

Hereinafter, the compensated gate driving voltage which may compensate for the distortion will be called 'compensation gate driving voltage' for convenience of description.

Figure 4:
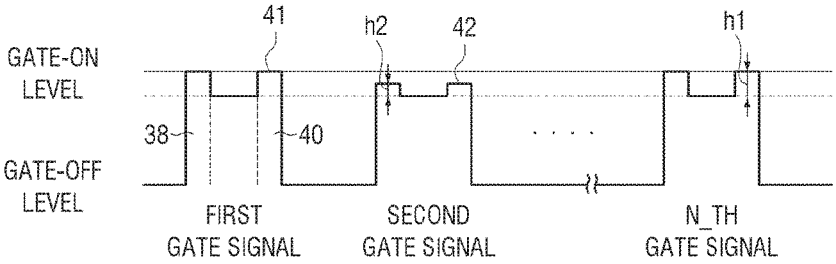
FIG. 4 is a view provided to describe a waveform of a gate driving voltage for compensating for an insufficient charging time at each frame according to feedback, according to an exemplary embodiment.

FIG. 4 is a view provided to describe a waveform of a gate driving voltage for compensating for an insufficient charging time at each frame according to feedback, according to an exemplary embodiment.

As illustrated in FIG. 4, the controller 140 may apply the compensation gate driving voltage to each gate line at each frame. For example, the compensation gate driving voltage applied to each gate line may have a different form according to a degree of distortion of the gate driving voltage at each frame.

For example, in response to a first gate driving voltage being applied to a gate line at a certain frame, an OFF-ON section 38 and an ON-OFF section 40 of a waveform 41 of a first gate signal of the gate driving voltage may have a higher value than a gate-on level 44 by an amount of a first height h1. In response to a second gate driving voltage being applied to a gate line at a subsequent frame, an OFF-ON section 38 and an ON-OFF section 40 of a waveform 42 of a second gate signal of the gate driving voltage may have a higher value than the gate-on level 44 by an amount of a second height h2 smaller than the first height h1. In response to an Nth gate driving voltage being applied to a gate line at a last frame, an OFF-ON section 38 and an ON-OFF section 40 of a waveform 46 of an Nth gate signal of the gate driving voltage may have a higher value than the gate-on level 44 by an amount of the first height h1 or any other appropriate amount. That is, the signal corresponding to the compensation gate driving voltage applied to each frame may have a different waveform with sections having different amplitude or amplitudes, which may be determined by a gate driving voltage which is fed back from a previous frame.

For example, the controller 140 may receive feedback on a gate driving voltage applied to at least one pixel among the plurality of pixels of the gate line. For example, the controller 140 may receive feedback on a gate driving voltage applied to at least one pixel located at a position which is farthest from the gate driver IC 130 among the plurality of pixels of each gate line. The controller 140 may receive, as a feedback signal, the gate driving voltage which has been most recently applied, from a pixel at the gate line, and detect the distortion based on the received gate driving voltage. For example, the pixel may be a pixel disposed at a farthest position from the gate driver IC, on a gate line, e.g., a pixel corresponding to the capacitor CN. The controller 140 may quantify an amount of distortion of the gate driving voltage applied to the pixel by comparison with an undistorted normal gate driving voltage and generate a compensation gate driving to compensate the amount of distortion of the voltage signal amplitude, for example, by adding a comparison difference value to the undistorted voltage signal value. The generated compensation gate driving voltage may be applied to a gate line at a subsequent frame to reduce a difference in the charging voltages in the frame.

A waveform of the compensation gate driving voltage is determined according to the amount of distortion detected based on the feedback on the gate driving voltage, and thus, a compensation gate driving voltage at each frame may have a different form.

Figure 5A:
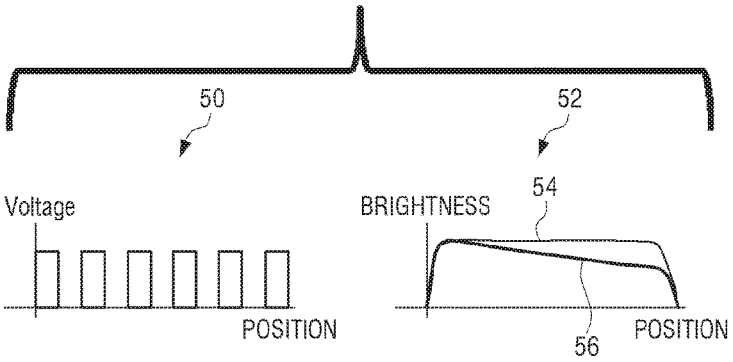
FIG. 5A (RELATED ART)
FIGS. 5A and 5B are views provided to describe a method for adjusting brightness according to a position of a backlight in order to maintain brightness of a panel consistently, according to an exemplary embodiment.
Figure 5B:
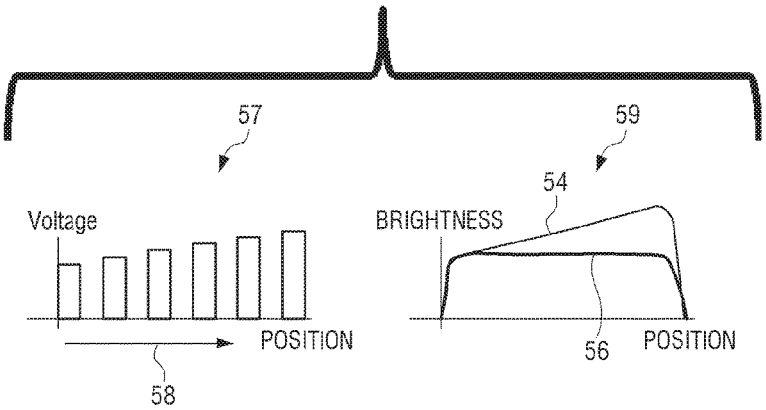

FIGS. 5A and 5B are views provided to describe a method for adjusting brightness according to a position of a backlight in order to maintain brightness of a panel consistently.

FIG. 5A illustrates brightness of a backlight when a backlight unit for supplying a backlight to a display panel provides consistent brightness regardless of a position of a pixel.

According to FIG. 5A, a level of a driving voltage according to a position of a backlight may be expressed as a graph 50. In the graph 50, a horizontal axis represents a position of the backlight unit 160, e.g., a position of a light source of the backlight unit, corresponding to each pixel at one gate line, and a vertical axis represents a level of a driving voltage of the backlight driver 170 at each position. That is, the backlight driver 170 applies a consistent driving voltage regardless of a position of the backlight unit 160.

For example, as illustrated in a graph 52 of FIG. 5A, in response to a consistent driving voltage being applied to the backlight unit 160 regardless of the position on the backlight unit 160, a difference may occur between the brightness of the backlight unit 160 (graph 54) and the brightness of the display panel 110 (graph 56). For example, the brightness of a pixel which is far from the gate driver IC 130 may be relatively lower than the brightness of a pixel which is closer to the gate driver IC 130 according to the difference in the charging time due to the RC delay.

According to an exemplary embodiment, a brightness difference according to a difference in a charging time may be minimized by applying a different level of driving voltages according to the position of the light source of the backlight unit 160. As illustrated in a graph 57 of FIG. 5B, the backlight driver 170 may drive the backlight unit 160 such that the brightness of the backlight supplied to the backlight unit 160 increases in a direction 58 away from the gate driver IC 130. For example, the backlight driver 170 may increase the brightness of the backlight linearly or non-linearly.

For example, an imbalance of the brightness due to the insufficient charging time may be compensated by the backlight 160 which increases the brightness in the direction away from the gate driver IC 130. Accordingly, as illustrated in graph 59 of FIG. 5B, the brightness supplied by the backlight unit 160 (graph 54) may increase in the direction away from the gate driver IC 130 such that the brightness of the display panel 110 (graph 56) is maintained at a consistent level regardless of a distance of a pixel from the gate driver IC 130. That is, the backlight driver 170 may compensate for the imbalance between the left-side brightness and the right-side brightness of the display panel 110 by driving the backlight such that the backlight driving voltage is applied differently at each position of the light source of the backlight unit 160.

A brightness value provided by each light source of the backlight unit 160 to compensate for the imbalance between left-side brightness and right-side brightness of the display panel 110 may be preset and stored in advance, for example, during a manufacturing process.

For example, the display apparatus 100 may further include a storage device 98 (refer to FIG. 1). The storage may include a lookup table where each of the plurality of pixels of the display panel is matched with a brightness value of a light source which needs to be irradiated to each of the pixels in order to maintain the brightness of the display panel consistently according to a position of each of the pixels of the display panel.

FIG. 6 is a view provided to describe a lookup table 60 where backlight brightness values adjusted according to RC delay values are matched with the RC delay values according to an exemplary embodiment. As illustrated in FIG. 6, the backlight driver 170 may drive the backlight unit 160 by using the lookup table stored in the storage.

As illustrated in FIG. 6, the lookup table matches and stores RC delay values and brightness values of a backlight in such a way that a brightness value of an adjusted backlight increases toward a pixel having a great RC delay value. The brightness value of the backlight unit 160 according to the RC delay may be measured and stored as a predetermined value in a design and manufacturing process of the display apparatus 100.

FIG. 6 illustrates only four RC delay values which are matched with the corresponding brightness values, but brightness values of the light sources corresponding to different ones and/or more RC delay values may be stored.

Figure 8:
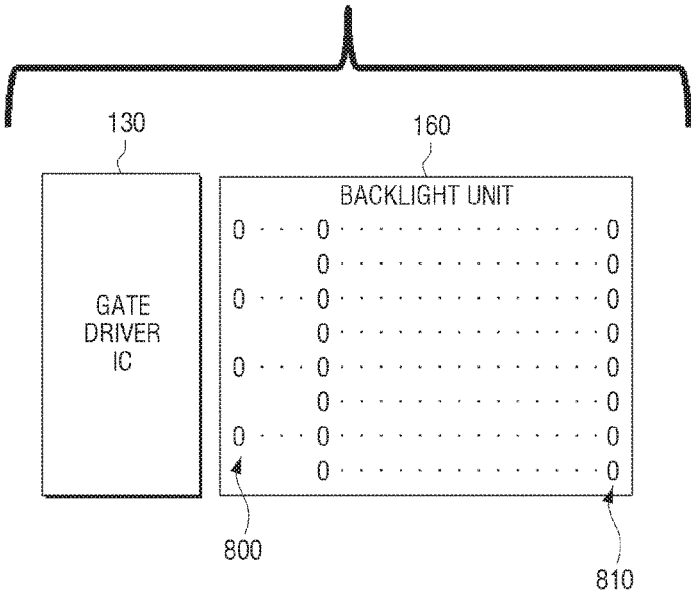
FIG. 8 is a view of a backlight unit, according to an exemplary embodiment.

As shown in FIG. 8, according to an exemplary embodiment, in the backlight unit 160, a position of a light source may be adjusted, e.g., by a physical position or by appropriate control of activation function, such that the brightness of the pixels of each gate line is consistent.

That is, a distance between the light sources which supply a backlight to each pixel of the gate lines may be adjusted in such a way that the light sources 800 located closer to the gate driver IC 130 are arranged with a greater distance therebetween, and the light sources 810 located farther away from the gate driver IC 130 are arranged with a smaller distance therebetween.

Accordingly, the brightness of the backlight by the light sources 810 located farther away from the gate driver IC 130 is made higher than the brightness of the backlight by the light sources 800 located closer to the gate driver IC 130. Accordingly, the brightness difference may further offset the brightness difference due to the difference in the charging time and reduce the imbalance of the brightness of the display panel 110. For example, the brightness of the backlight unit 160 according to the RC delay may be measured in the design and manufacturing process of the display apparatus 100, and the light sources of the backlight unit 160 may be arranged with the adjusted distance such that the brightness of the display panel 110 is maintained consistently based on the measured brightness values.

Figure 7:
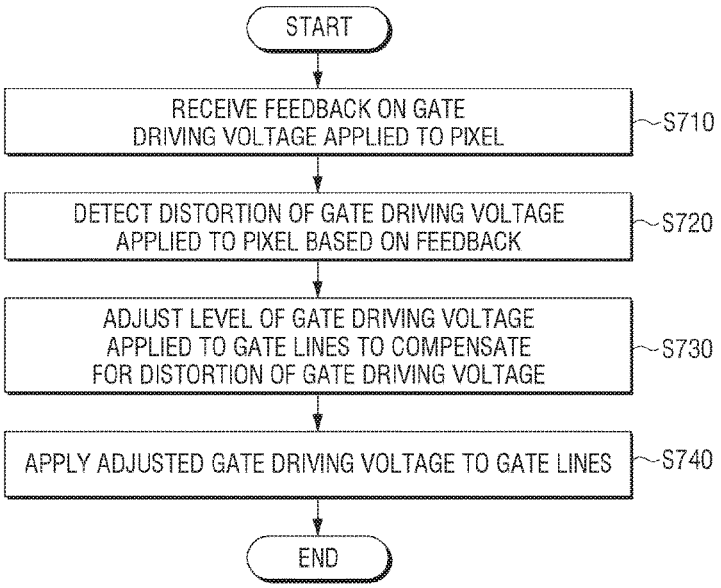
FIG. 7 is a flowchart provided to describe a method for controlling a display apparatus according to an exemplary embodiment.

FIG. 7 is a flowchart provided to describe a method for controlling a display apparatus according to an exemplary embodiment.

On the display panel, feedback on a gate driving voltage applied to at least one pixel among a plurality of pixels arranged at an intersection of data lines to which a data voltage is applied by a source driver IC and gate lines to which a gate driving voltage is applied by a gate driver IC is received in operation S710. For example, the gate driving voltage may be applied as a square wave.

For example, feedback on a gate driving voltage applied to at least one pixel located at a position which is farthest from the gate driver IC among the plurality of pixels may be received.

Subsequently, distortion of the gate driving voltage applied to at least one pixel is detected based on the feedback in operation S720.

A level of the gate driving voltage applied to the gate lines is adjusted to compensate for the distortion of the gate driving voltage in operation S730. For example, in order to compensate for an insufficient charging time which occurs in at least one pixel due to the distortion of the gate driving voltage, a level of a voltage of a section which the insufficient charging time occurred in a square wave may be raised.

The adjusted gate driving voltage is applied to the gate lines in operation S740. The adjusted gate driving voltage may be applied according to a timing signal applied from a timing controller for controlling a timing at which a data voltage and a gate driving voltage are applied.

The brightness of a backlight supplied to a backlight unit may be increased in a direction away from the gate driver IC. For example, a synchronization signal may be generated every time the gate driving voltage is applied to the gate lines, and the backlight may be supplied upon the gate driving voltage being applied based on the generated synchronization signal. According to a position of each pixel of the display panel, the brightness of the backlight may be increased by using a lookup table where each of the plurality of pixels of the display panel is matched with a brightness value of a light source to be irradiated to each of the pixels in order to maintain brightness of the display panel consistently according to a position of each of the pixels of the display panel. For example, the brightness of the backlight may be increased linearly.

According to the above-described various exemplary embodiments, deterioration of the brightness uniformity due to a signal delay at a gate line may be improved by reducing a difference in a charging voltage amount of a left-side pixel and a right-side pixel of a display panel.

According to the above-described various exemplary embodiments, the method for controlling a display apparatus may be realized as a program and stored in diverse type of recording mediums. That is, a computer program which is processed by a various processors and executes the above-described methods may be stored in a recoding medium and executed.

As an example, a non-transitory computer-readable medium, including a program for executing operations of receiving feedback on a gate driving voltage applied to at least one pixel among a plurality of pixels arranged at an intersection of data lines to which a data voltage is applied by a source driver IC and gate lines to which a gate driving voltage is applied by a gate driver IC, detecting distortion of the gate driving voltage applied to at least one pixel based on the feedback, adjusting a level of the gate driving voltage applied to the gate lines to compensate for the distortion of the gate driving voltage, and applying the adjusted gate driving voltage to the gate lines, may be provided.

The non-transitory computer-readable recording medium refers to a medium which may store data permanently or semi-permanently rather than storing data for a short time, such as, register, cache, memory, and the like, and may be readable by an apparatus. For example, the above-described various applications and programs may be stored in and provided through the non-transitory computer-readable recording medium, such as, compact disc (CD), digital versatile disk (DVD), hard disk, Blu-ray disk, universal serial bus (USB), memory card, Read-Only Memory (ROM), and the like.

Although a few exemplary embodiments have been shown and described, it would be appreciated by those skilled in the art that changes may be made in the exemplary embodiments without departing from the principles and spirit of the disclosure, the scope of which is defined in the claims and their equivalents.

What is claimed is:

1. A display apparatus comprising:

a display panel configured to include a plurality of pixels arranged at intersections of data lines and gate lines;

a source driver integrated circuit (IC) disposed on one side surface of the display panel and configured to apply a data voltage to the data lines;

a gate driver IC disposed on one of two side surfaces of the display panel that are adjacent to the one side surface of the display panel and configured to apply a gate driving voltage to the gate lines; and a controller configured to receive, as a feedback signal, information on a gate driving voltage, applied to at least one pixel on a gate line from among the gate lines, detect a distortion of the gate driving voltage applied to the at least one pixel of the gate line based on the feedback signal, identify a degree of the distortion of the gate driving voltage, increase a level of the gate driving voltage applied to the gate lines according to the identified degree of the distortion for compensating the detected distortion of the gate driving voltage, and apply the increased gate driving voltage to the gate lines, wherein the at least one pixel is located at a position farthest away from the gate driver IC on the gate line.

2. The display apparatus as claimed in claim 1, further comprising:

a timing controller configured to control a timing at which the data voltage and the gate driving voltage are applied, wherein the controller is disposed between the timing controller and the gate driver IC and is further configured to apply the increased gate driving voltage based on a timing signal applied from the timing controller.

3. The display apparatus as claimed in claim 1, wherein the gate driving voltage is applied to the gate lines as a square wave, wherein, in response to an insufficient charging time occurring in the at least one pixel due to the distortion of the gate driving voltage, the controller is further configured to raise a level of a voltage of a section, in which the insufficient charging time occurred, in the square wave, in order to compensate for the insufficient charging time.

4. The display apparatus as claimed in claim 1, further comprising:

a backlight unit configured to supply a backlight to the display panel; and a backlight driver configured to drive the backlight unit, wherein the backlight driver is further configured to drive the backlight unit such that a brightness of the backlight supplied from the backlight unit increases in a direction away from the gate driver IC.

5. The display apparatus as claimed in claim 4, wherein the controller is further configured to generate a synchronization signal every time the gate driving voltage is applied to the gate lines and transmit the generated synchronization signal to the backlight driver, wherein the backlight driver is further configured to drive the backlight unit to supply the backlight upon the gate driving voltage being applied based on the received synchronization signal.

6. The display apparatus as claimed in claim 5, further comprising:

a storage configured to pre-store a lookup table where each of the plurality of pixels of the display panel is matched with brightness values of light sources of the backlight unit to be irradiated to the plurality of pixels in order to maintain the brightness of the display panel at a certain consistent level according to a position of each of the plurality of pixels of the display panel, wherein the backlight driver is further configured to drive the backlight unit by using the pre-stored lookup table.

7. The display apparatus as claimed in claim 4, wherein the backlight driver is further configured to linearly increase the brightness of the backlight in the direction away from the gate driver IC.

8. The display apparatus as claimed in claim 1, further comprising:

a backlight unit configured to supply a backlight to the display panel; and a backlight driver configured to drive the backlight unit, wherein positions of light sources of the backlight unit are adjusted such that a brightness of the plurality of pixels of the gate lines is maintained at a certain consistent level.

9. The display apparatus as claimed in claim 1, wherein the gate driver IC is further configured to apply the gate driving voltage as a square wave to the gate lines, wherein, based on a difference between a level of the gate driving voltage applied to a gate of a first pixel located on one of the gate lines at a position closest to the gate driver IC and a level of the gate driving voltage which has been applied to the at least one pixel, the controller is further configured to raise a level of the gate driving voltage of a section of the square wave, to compensate for the difference.

10. A method for controlling a display apparatus, the method comprising:

receiving, as a feedback signal, information on a gate driving voltage, applied to at least one pixel, from among a plurality of pixels, on a gate line from among gate lines, wherein the plurality of pixels are arranged at intersections of data lines, to which a data voltage is applied by a source driver integrated circuit (IC), and the gate lines, to which a gate driving voltage is applied by a gate driver IC, on a display panel;

detecting a distortion of the gate driving voltage applied to the at least one pixel of the gate line based on the feedback signal;

identifying a degree of the distortion of the gate driving voltage;

increasing a level of the gate driving voltage applied to the gate lines according to the identified degree of the distortion for compensating the detected distortion of the gate driving voltage; and applying the increased gate driving voltage to the gate lines, wherein the at least one pixel is located at a position farthest away from the gate driver IC on the gate line.

11. The method as claimed in claim 10, wherein the applying comprises:

applying the increased gate driving voltage based on a timing signal applied from a timing controller configured to control a timing at which the data voltage and the gate driving voltage are applied.

12. The method as claimed in claim 11, wherein the gate driving voltage is applied to the gate lines as a square wave, and the increasing comprises raising a level of a voltage of a section, in which an insufficient charging time occurred, of the square wave, in order to compensate for the insufficient charging time, in response to the insufficient charging time occurring in the at least one pixel due to the distortion of the gate driving voltage.

13. The method as claimed in claim 11, further comprising:

increasing a brightness of a backlight supplied from a backlight unit in a direction away from the gate driver IC.

14. The method as claimed in claim 13, wherein the increasing the brightness of the backlight comprises:

generating a synchronization signal every time the gate driving voltage is applied to the gate lines; and supplying the backlight upon the gate driving voltage being applied based on the received synchronization signal.

15. The method as claimed in claim 14, wherein the increasing the brightness of the backlight further comprises:

increasing the brightness of the backlight by using a lookup table where each of the plurality of pixels of the display panel is matched with brightness values of light sources of the backlight unit to be irradiated to the plurality of pixels in order to maintain the brightness of the display panel at a certain consistent level according to a position of each of the plurality of pixels of the display panel.

16. The method as claimed in claim 13, wherein the increasing the brightness of the backlight comprises:

linearly increasing the brightness of the backlight in the direction away from the gate driver IC.

17. A non-transitory computer-readable recording medium having recorded thereon a program, which program, when executed by a computer system, causes the computer system to execute the method of claim 10.

18. A display apparatus comprising:

a display panel configured to display successive frames and includes pixels arranged at intersections of data lines and gate lines;

a source driver integrated circuit (IC) configured to apply a data voltage to the data lines;

a gate driver IC configured to apply, as a waveform, a gate driving voltage to the gate lines; and a controller configured to compensate for a distortion of the waveform of the gate driving voltage applied along a gate line of the gate lines by:

obtaining, as a feedback signal, information on a gate driving voltage applied in a preceding frame to a last pixel located on a respective gate line among the gate lines, detecting a distortion of the gate driving voltage applied to the last pixel by comparing an amplitude value of the waveform corresponding to the feedback signal with an amplitude value of the waveform of the gate driving voltage which has been applied in the preceding frame to a first pixel located on the respective gate line, or of a reference waveform corresponding to an undistorted gate driving voltage, identifying a degree of the distortion of the gate driving voltage, adjusting the amplitude value according to the identified degree of the distortion in a portion of the waveform which has been detected as distorted in the preceding frame, and applying the gate driving voltage having the adjusted amplitude value in the portion of the waveform to the gate lines, in a current frame subsequent to the preceding frame, of the successive frames, for compensating for the distortion of the gate driving voltage in the current frame, wherein the last pixel is located at a position farthest away from the gate driver IC on the respective gate line among the gate lines.

19. The display apparatus of claim 18, wherein the display panel includes a first side surface, a second side surface, a third side surface, and a fourth side surface adjacent one another, the source driver IC is disposed at the first side surface, and the gate driver IC is disposed at the second side surface adjacent to the first side surface, but is not disposed on the fourth side surface adjacent the first side surface and opposite the second side surface.

* * * * *